US005955713A

United States Patent [19]

Titus et al.

[11] Patent Number: 5,955,713

[45] Date of Patent: Sep. 21, 1999

[54] TILT SWITCH ARRAY FOR ELECTRONIC ORIENTATION DETECTION

[75] Inventors: John S. Titus, Prior Lake, Minn.; Leonard P Tetrault, Northport; John Peters, Jr., Center Moriches, both of N.Y.

[73] Assignees: Circle Seal Corporation, Ronkonkoma, N.Y.; Joint Techno Concepts International, Inc., Westboro, Mass.

[21] Appl. No.: 08/943,780

[22] Filed: Oct. 3, 1997

[51] Int. Cl.[6] ..... H01H 35/02

[52] U.S. Cl. ..... 200/61.52; 33/366.11; 33/391; 200/277

[58] Field of Search ..... 200/277, 188, 200/187, 225, 224, 61.52, 61.48, 61.51, 61.47; 33/391, 366.11, 366.24, 366.26

[56] References Cited

U.S. PATENT DOCUMENTS

| | | | |
|---|---|---|---|
| 2,450,780 | 10/1948 | Bucklen, III | 200/225 |
| 3,729,602 | 4/1973 | Myers | 200/61.52 |
| 3,812,308 | 5/1974 | Bell et al. | 200/61.45 |
| 3,927,286 | 12/1975 | Fohl | 200/61.52 X |
| 4,090,040 | 5/1978 | Berland | 179/107 |
| 4,135,067 | 1/1979 | Bitko | 200/61.52 |
| 4,467,154 | 8/1984 | Hill | 200/61.45 |
| 4,513,183 | 4/1985 | Hill | 200/61.45 |
| 4,618,746 | 10/1986 | Schwob et al. | 200/61.45 |
| 4,668,846 | 5/1987 | Klumpp | 200/61.45 |
| 5,006,676 | 4/1991 | Bogut et al. | 200/61.52 |
| 5,630,280 | 5/1997 | Crossan, Jr. | 33/366.11 |

*Primary Examiner*—Renee S. Luebke
*Attorney, Agent, or Firm*—Merchant, Gould, Smith, Edell, Welter & Schmidt, P.A.

[57] ABSTRACT

A tilt switch array is used to determine the orientation of an object relative to an upwards direction. The array includes at least one pair of electrodes within a housing, diametrically opposed along a measurement axis. A conductor equidistantly surrounds each electrode to form a tilt switch gap therebetween. A moveable conducting element within the housing closes the gap between one electrode and its associated conductor under certain orientation conditions of the measurement axis relative to an upwards direction. A number of pairs of electrodes may be placed within the housing, with associated measurement axes so that the orientation of any one of the measurement axes may be detected.

17 Claims, 8 Drawing Sheets

TILT SWITCH ARRAY FOR ELECTRONIC ORIENTATION DETECTION

BACKGROUND OF THE INVENTION

This invention relates in general to an apparatus for detecting the orientation of an object, and particularly to a tilt switch for detecting a particular orientation.

Tilt switches and jitter switches are used in portable electronic devices, such as radio transceivers and paging units, to detect whether the unit is in an non-vertical orientation, and to detect movement of the device. Tilt switches may be used for generating a signal when non-vertical orientation is detected, for example in "mandown" situations where police officers are injured. Further, tilt switches operating as jitter switches can be used for detecting continued motion of a portable device, the lack of such motion typically causing the generation of an alert signal.

A conventional tilt switch includes a glass envelope that contains a ball of mercury. A pair of electrodes are situated at one end of the envelope and the mercury forms an electrical contact between the electrodes when the switch is oriented so that the mercury extends to the ends of the envelope containing the electrodes, thus forming an electrical contact therebetween. In certain applications, it is important to measure whether an electronic device is oriented upwards, downwards, or at an angle in between. For some applications, it is possible to use a number of conventional tilt switches together, where each tilt switch is mounted at a different orientation so that the closing or opening of particular switches indicates the relative orientation of the device. However, the use of several individual tilt switches may take up significant real-estate in the device, and the individual switches must typically be mounted in precise orientation relative to each other in order for the combination of tilt switches to be effective.

Therefore, there is a need for a single tilt switch that can detect one of several orientations. Such a tilt switch should take up less volume within the device, and require that the orientation of only the single tilt switch within the device be precisely established, rather than the orientation of a number of switches.

SUMMARY OF THE INVENTION

To overcome the limitations in the prior art, including those described above, and to overcome other limitations that will become apparent upon reading and understanding the present specification, one particular embodiment of the present invention is directed to a tilt switch having an outer housing and an inner assembly disposed within the outer housing, the inner assembly having a first pair of apertured, opposing sides. A first plate is disposed between each respective side of the first pair of opposing sides and the outer housing, each first plate having a projection thereon to form an electrode region. The first plates are electrically isolated from each other and from the inner assembly, each electrode region and associated aperture perimeter in a respective opposing side together forming a switch gap. An electrically conductive element is movable within the inner assembly, so as to make electrical contact across one of the switch gaps by contacting one of the electrode regions and an associated aperture perimeter.

In another particular embodiment of the invention, a tilt switch array includes a housing having a first axis and a first detector having first and second electrodes aligned parallel to the first axis. The electrodes are disposed within the housing so as to oppose each other to form a first space therebetween. A first conductor has a perimeter substantially surrounding the first electrode and a second conductor has a perimeter substantially surrounding the second electrode. The first and second conductors are each nonparallel with respect to the first axis. A conducting element is movable within the first space so as to contact an electrode and an associated conductor.

The above summary of the present invention is not intended to describe each illustrated embodiment or every implementation of the present invention. Advantages and attainments, together with a more complete understanding of the invention, will become apparent and appreciated by referring to the following description and claims taken in conjunction with the accompanying drawings.

BRIEF DESCRIPTION OF THE DRAWINGS

Referring now to the drawings in which like reference numbers represent corresponding parts throughout.

Figure 1B:
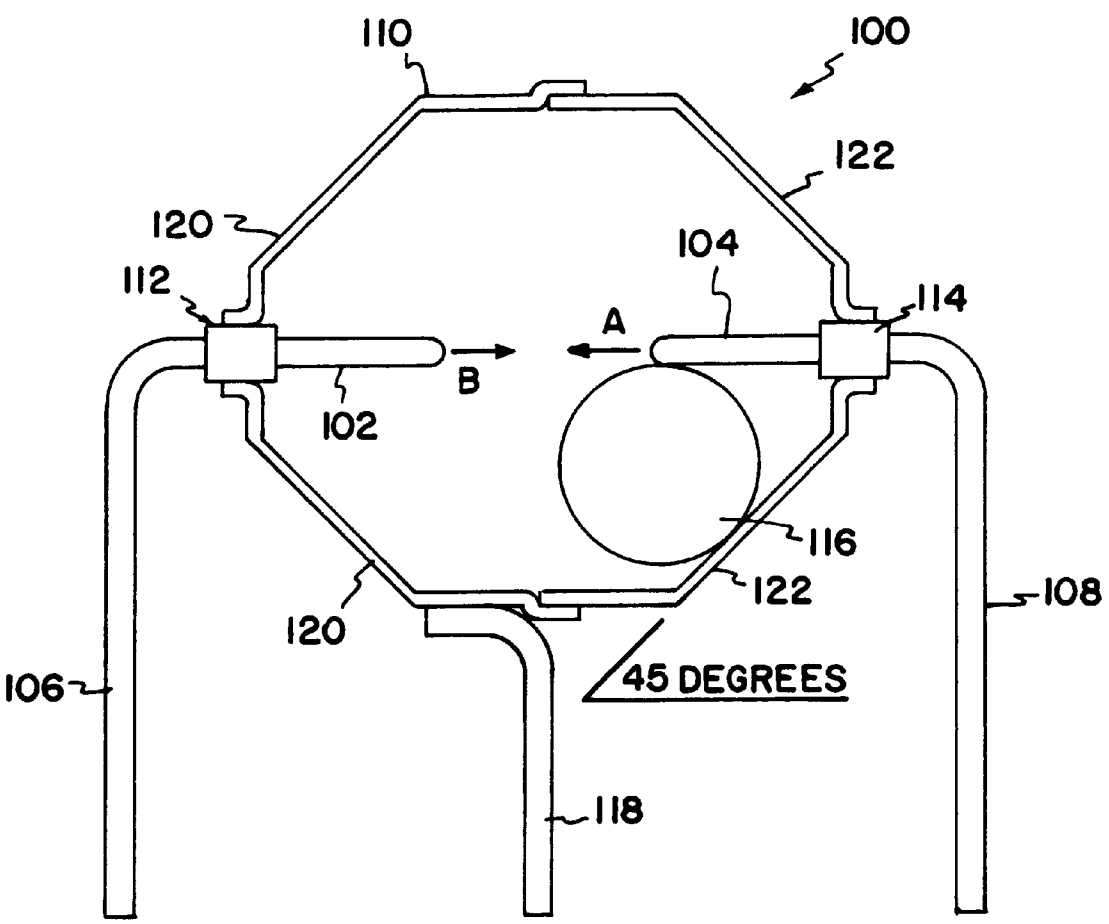
FIG. 1B illustrates a side view of the single axis tilt switch of FIG. 1A.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In the following description of the illustrated embodiments, reference is made to the accompanying drawings which form a part hereof, and in which is shown by way of illustration, various embodiments in which the invention may be practiced. It is to be understood that other embodiments may be utilized and structural changes may be made without departing from the scope of the present invention.

The present invention is directed to a tilt switch array. In one particular embodiment, a single tilt switch unit includes two or more tilt switch gaps, each of which can be closed by a metal ball, or other conducting element, free to move within the device. The tilt switch gaps are arranged along orthogonal axes, so that the orientation of these orthogonal axes relative to a downwards position may be measured. The present invention has application in small electronic devices in which an up/down orientation is to be measured. Examples of such electronic devices include radio transceivers, pagers, devices for locating buried electrical utilities and also electronic animal collars, as taught in U.S. Pat. No. 5,794,569. One advantage provided by the invention concerns the degree of control over the cone angle over which the tilt switch provides an "up" signal.

Figure 1A:
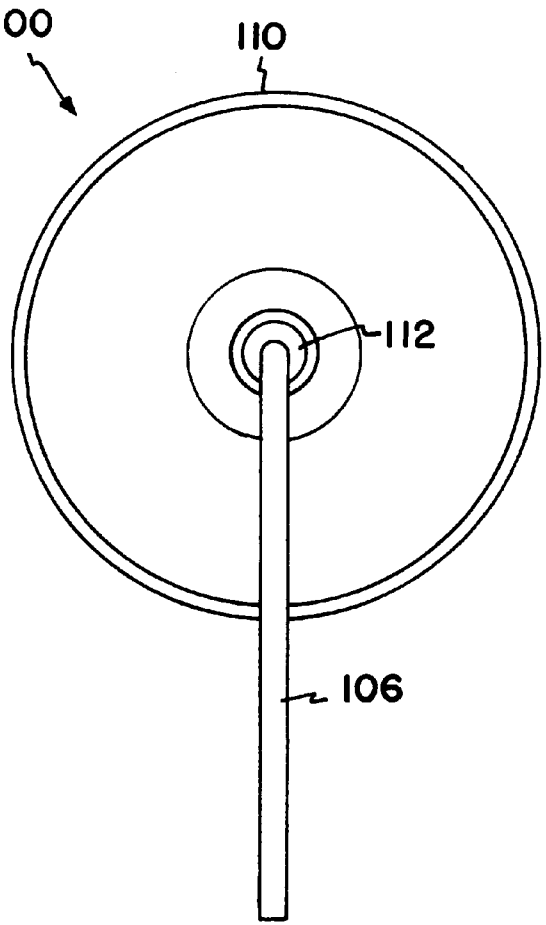
FIG. 1A illustrates an end view of a single axis tilt switch according to one embodiment of the invention.

FIGS. 1A and 1B illustrate one particular embodiment for the invention for detecting the orientation of a tilt switch array, generally indicated as 100, relative to an upward position direction. FIG. 1A illustrates an end view of such a tilt switch array 100 and FIG. 1B illustrates a cross section through the tilt switch array 100.

The tilt switch array 100 includes two centered electrodes 102 and 104 that are diametrically opposed and lying along a single axis of the tilt switch 100. The electrodes 102 and 104 are connected to respective external leads 106 and 108. The electrodes 102 and 104 are enclosed within a housing 110 with respective insulating seals 112 and 114 to allow the electrodes 102 and 104 to pass through from inside the housing. A conducting ball 116 is disposed within the housing 110 and is free to move within the housing 110 under external forces, as may be imparted to the ball 116 by gravity or acceleration due to motion.

The outer surface of the housing 110 is connected to a housing electrode 118. The housing 110 is electrically conducting, so that there is an electrically conductive path from the housing electrode 118 to, for example, the second lead 108 through the housing 110, the ball 116, and the second electrode 104, when the ball 116 simultaneously contacts the inner surface of the housing 110 and the electrode 104, as illustrated.

The housing is shaped so that those portions of the housing 110 surrounding the electrodes 102 and 104 form an angle, in this case 45°, relative to the axis lying between the electrodes 102 and 104. For example, the housing 110 includes a frustrated conical portion 120 surrounding the first electrode 102, and a second frustrated conical section 122 surrounding the second electrode 104. Thus, the ball 116 contacts the second electrode 104 and the right portion 122 of the housing 110 when the electrode 104 points in an upward direction or points within a cone no more than 45° away from an upward direction. The second electrode 104 is defined to point in the direction A, as shown. Thus, the second tilt switch between the housing lead 118 and the second lead 108 is closed when the second electrode 104 is pointing within ±45° of an upward direction.

Similarly, the first tilt switch between the first lead 106 and the housing lead 118 is closed when the ball 116 simultaneously contacts the first portion 120 of the housing 110 and the first electrode 102. The switch between the first lead and the housing lead 118 is closed when the first electrode 102 points within ±45° of an upward direction. The first electrode 102 is defined to point in the direction labeled "B."

When neither the first electrode 102 nor the second electrode 104 is pointing within ±45° of an upward direction, there is no stable position for the ball 116 to contact either electrode 102 or 104. Thus, neither the first or second tilt switches are closed when the tilt switch array 100 is in this position.

Figure 2:
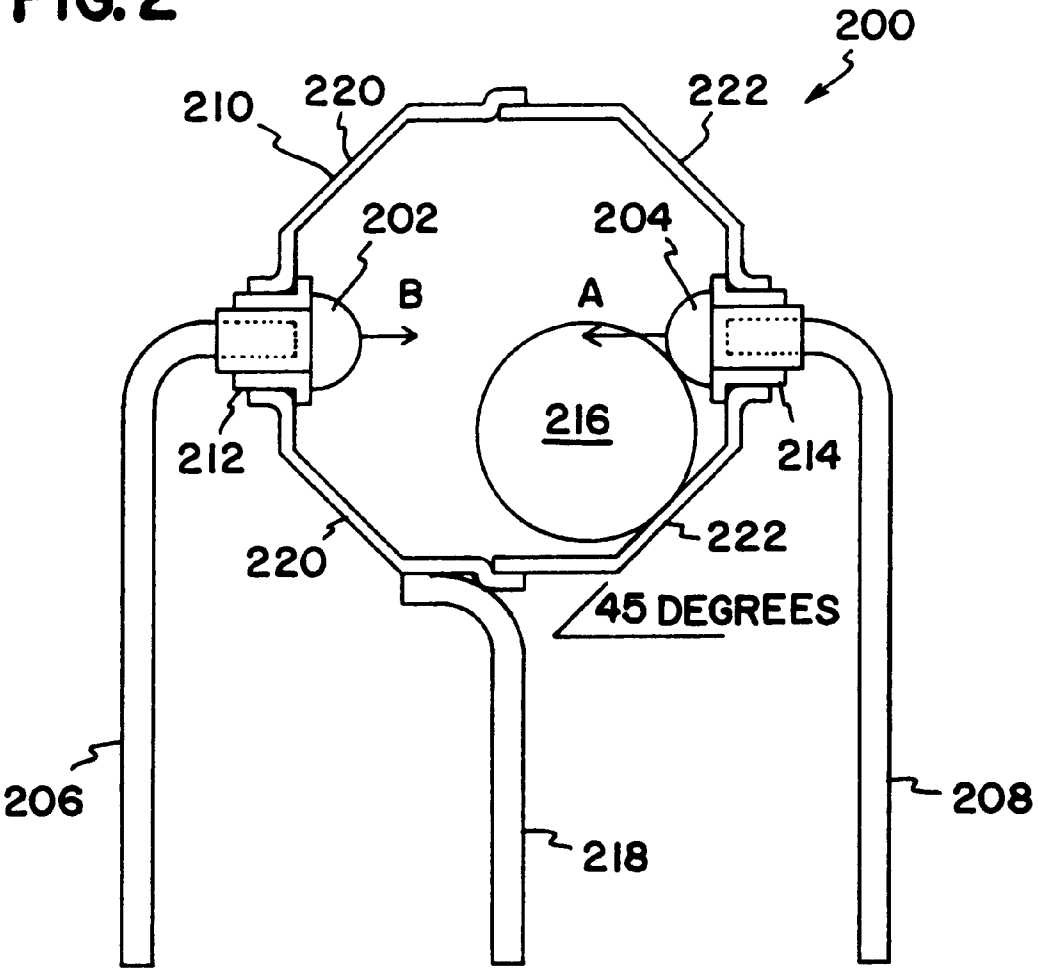
FIG. 2 illustrates a single axis tilt switch array according to another embodiment of the present invention.

Another embodiment of a single axis tilt switch array 200 is illustrated in FIG. 2. The tilt switch array 200 includes a housing 210 with first and second leads 206 and 208 and a housing lead 218 for attachment to an external circuit. The housing 210 has first and second conical portions 220 and 222 around respective first and second electrodes 202 and 204. A ball 216 is contained within the housing 210 and is free to move around therein, to form contacts between the housing 210 and either of the electrodes 202 and 204. Here, the tilt switch array 200 is similar to that illustrated in FIG. 1, except the electrodes 202 and 204 have round heads. Each electrode 202 and 204 may be a semi-tubular rivet with respective leads 206 and 208 contacted inside the respective tubes. Insulating bushings 212 and 214 electrically insulate the housing 210 from the electrodes 202 and 204.

Both of the single axis tilt switch arrays 100 and 200 may include gas-tight sealed housings 110 and 210 where the housing is filled with an inert gas in order to prevent corrosion of the electrically conducting surfaces within the housings 110 and 210. The inner surface of the housing 110 and 210 may be plated with a highly conducting metal, for example, gold or copper. Likewise, the electrodes 102 and 104, and 202 and 204, and the electrically conducting balls 116 and 216 may also be coated with a highly conducting metal such as gold or copper.

It will be appreciated that the angle of the frustrated conical sections of the housings may be chosen to be either larger or smaller than 45° in order to close the tilt switch when it is aligned within a larger or smaller angle relative to the upwards direction, It will also be appreciated that the single axis tilt switch arrays may be modified to accept a second pair of electrodes disposed along an axis orthogonal to the axis between the first pair of electrodes so that the tilt switch array may be used for detecting orientation along two different axes relative to an upward direction. Additionally, a third pair of electrodes may be provided along an axis mutually orthogonal to the first two electrode axes in order to permit the detection of the orientation of the tilt switch array along three directions.

Figure 3B:
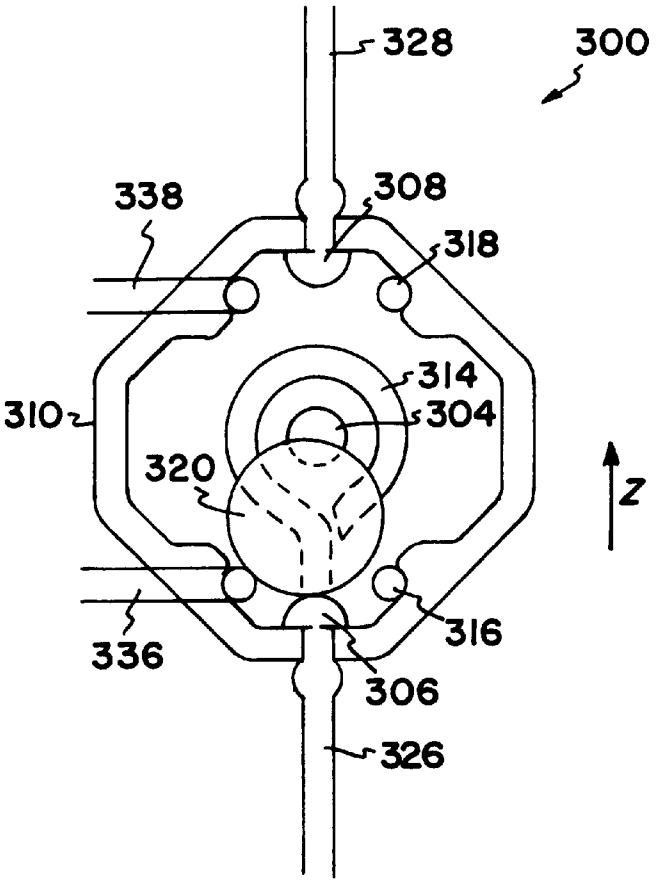
FIG. 3B illustrates an orthogonal view through the tilt switch array of FIG. 3A, as viewed through section 3B—3B.
Figure 3A:
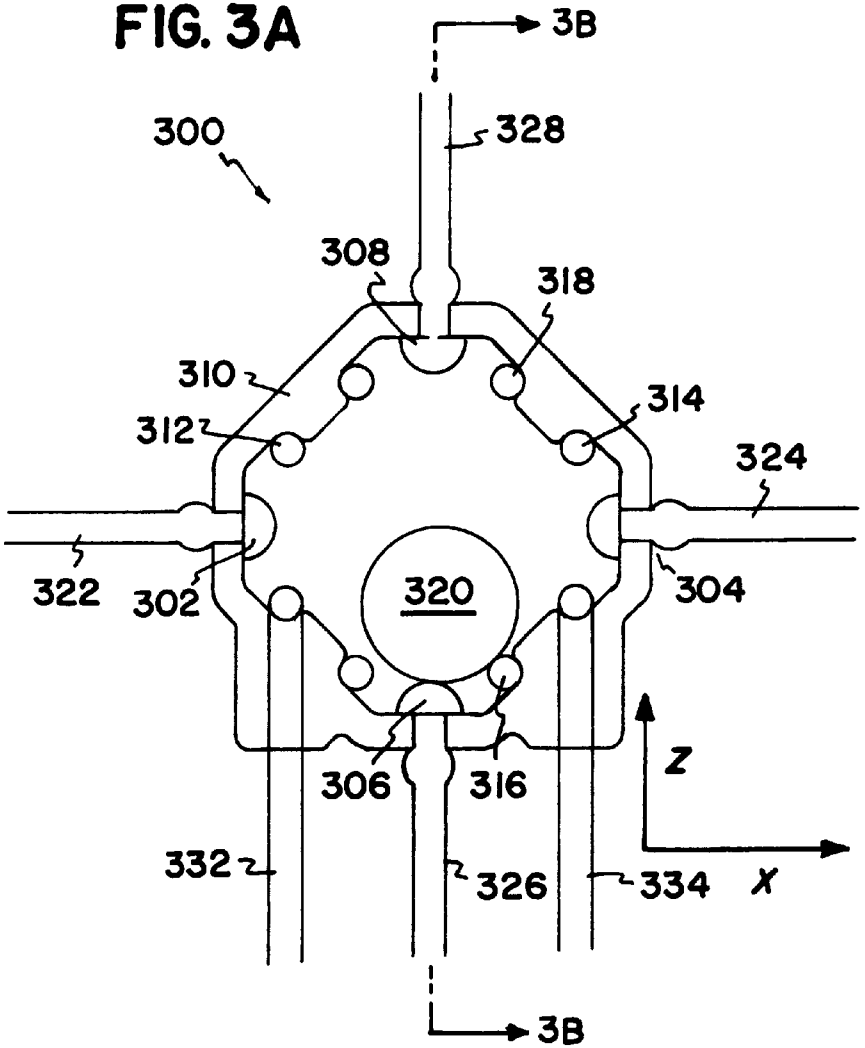
FIG. 3A illustrates a cross-section through a two axis tilt switch array according to another embodiment of the invention.

FIGS. 3A and 3B illustrate one particular embodiment of the invention that permits the detection of the orientation of two orthogonal axes relative to an upward direction.

The tilt switch array 300 includes an insulated housing 310 that has two pairs of mutually orthogonally arranged electrodes therein. The first pair of electrodes 302 and 304 are disposed along the x-axis, and the second pair of electrodes 306 and 308 are disposed along the z-axis, orthogonal to the x-axis.

Each electrode 302, 304, 306, and 308 has an associated lead extending outwardly from the housing 310 for connection to an external circuit. Surrounding each electrode 302, 304, 306, and 308 is a respective metallic ring 312, 314, 316, and 318. Each ring 312, 314, 316, and 318 has an associated lead 332, 334, 336, and 338 extending through the housing 310 for connection to the external circuit. The external circuit permits the user to determine which particular tilt switch, i.e. electrode/ring combination in the tilt switch array, is closed by the ball 320.

The position and diameter of each ring relative to its respective electrode is chosen so that the tilt switch array 300 can detect when an electrode is directed to within ±45° of an upward direction. For example, as illustrated, the ball 320 rests on the electrode 306 and its associated ring 316, thus closing the electrical gap therebetween. If the tilt switch array 300 is tilted so that the z-axis is directed at more than a selected angle, $\theta_s$, then the ball 320 falls out from the gap between the electrode 306 and ring 316. The ball 320 may then find another stable position in a gap between another electrode 302, 304, or 308 and its associated ring 312, 314 and 318 that points to within $\pm\theta_s$ of an upward direction. In certain applications, $\theta_s$ may be selected to be 45°.

It will be appreciated that this embodiment may be adapted for detection of orientation along three axes, with the addition of a third pair of electrodes oriented orthogonally to the first two pairs of electrodes, and with concomitant rings surrounding the electrodes.

Figure 4B:
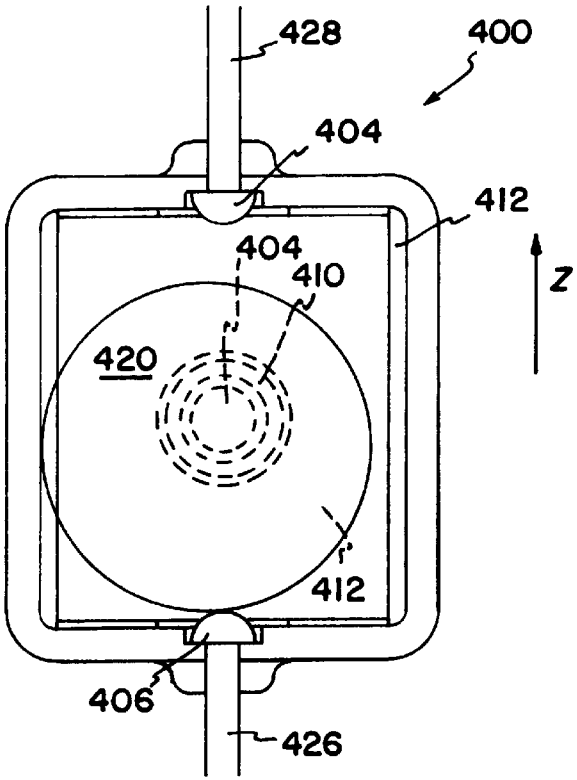
FIG. 4B illustrates an orthogonal view through the tilt switch array of FIG. 4A, as viewed through section 4B—4B.
Figure 4A:
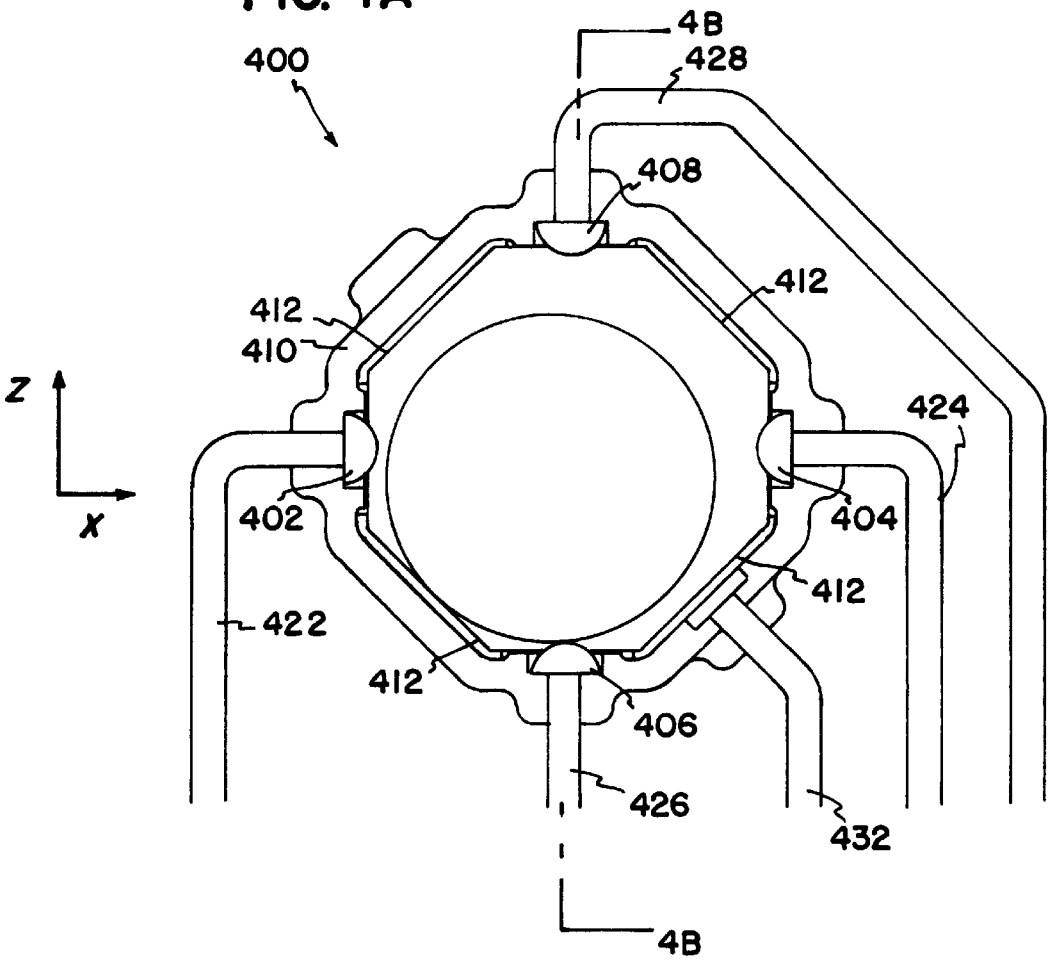
FIG. 4A illustrates a cross-section through a two axis tilt switch array according to another embodiment of the invention.

Another particular embodiment of a two-axis tilt switch array 400 is illustrated in FIGS. 4A and 4B. In this embodiment, an insulated housing 410 has disposed therein four electrodes 402, 404, 406, and 408, in pairs directed along orthogonal axes x and z. Each electrode 402, 404, 406, and 408 has an associated lead 422, 424, 246, and 428 for connection to an external circuit for determining the orientation of the tilt switch array 400. A conducting liner 412 is positioned within the housing 410, the liner 412 substantially covering the inner surface of the housing 410, apart from those portions immediately surrounding the electrodes 402, 404, 406, and 408. The lining 412 is electrically isolated from each of the electrodes 402, 404, 406, and 408 by gaps therebetween. The walls of the housing 410 form frustrated conical portions surrounding each of the electrodes 402, 404, 406, and 408 in a manner similar to that shown in FIGS. 1A and 2. The ball 420 is free to move within the housing 410, and forms an electrical contact between the lining 412 and any electrode 402, 404, 406 or 408 that is pointing in a direction within ±45° of an upward direction. Thus, the orientation of two axes of the tilt switch array 400, namely the x and z-axes, relative to an upward direction may be determined in response to which of the tilt switches formed by the electrodes 402, 404, 406, and 408 and the lining 412 is closed by the ball 420.

Figure 5:
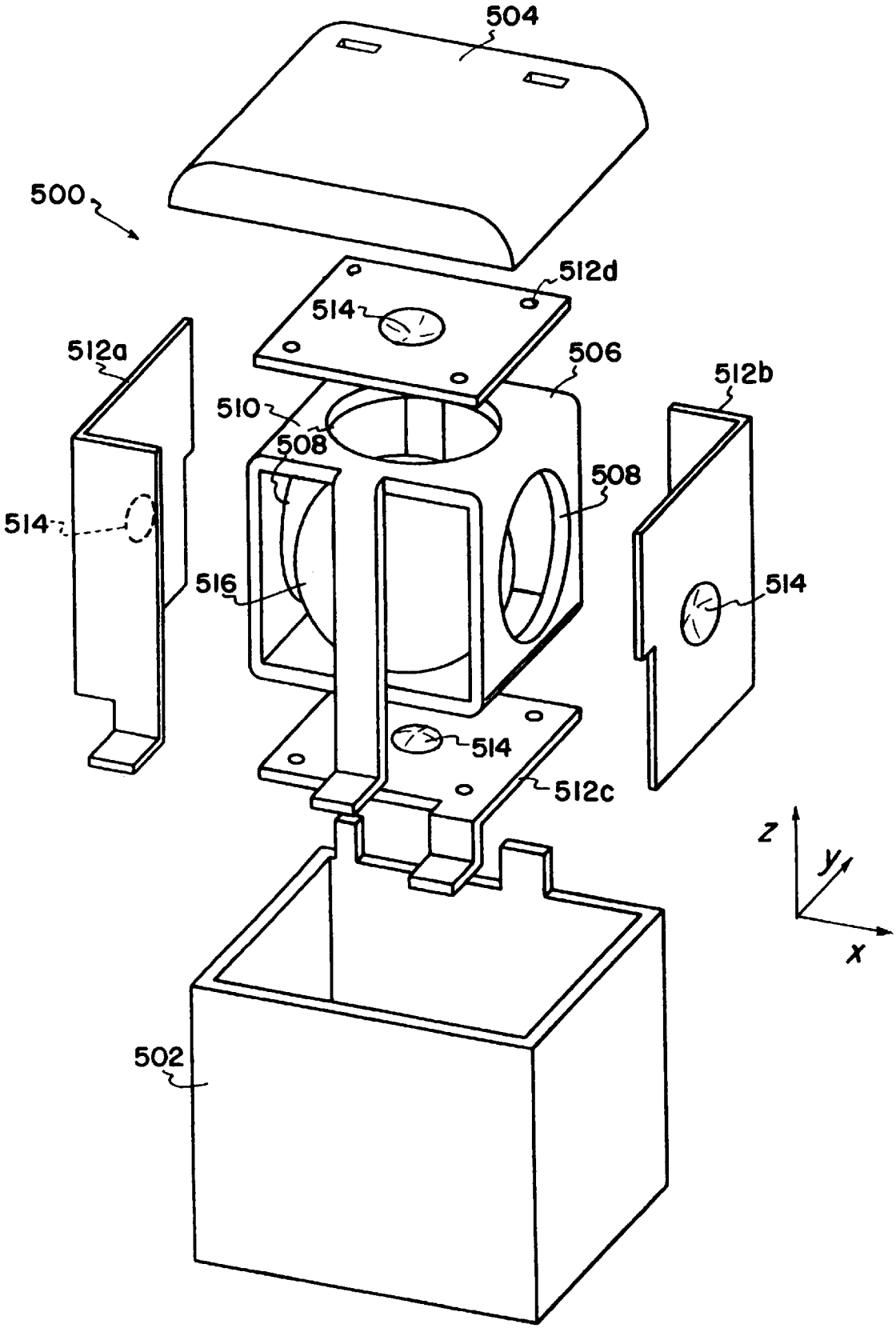
FIG. 5 illustrates another multi-axis tilt switch array according to another embodiment of the present invention.

FIG. 5 illustrates one particular embodiment of the invention for detecting orientation of the tilt switch array 500 relative to two orthogonal axes. In the case shown, the tilt switch array 500 detects orientation of the x- and z-axes relative to the upward direction. FIG. 5 illustrates an exploded view of the tilt switch array 500. The housing 502 and lid 504 enclose all the components, other than electrical connections (not shown). Inside the housing 502 is an inner assembly 506. The inner assembly 506 has apertures 508 on opposing walls 510. Plates 512*a*–512*d* are inserted between the opposing walls 510 and the housing 502. Each plate 512*a*–512*d* has a raised portion 514 in the center, raised in the direction of the conducting ball 516 which is centrally located but free to move within the inner assembly 506.

The tilt switch array 500 operates in the following manner, which is described with reference to FIG. 6, a schematic cross-section in the x-z plane of the tilt switch array 500. The plates 512*a*–512*d* are electrically isolated from each other, and from the inner assembly 506, which acts as a common. In any a particular orientation, the ball 516 falls to the lowest point within the inner assembly 506 under the pull of gravity. Over a wide range of angles, this position is reached when the conducting ball 516 rests against the raised portion 514 and the edge of the aperture 508. When in such a condition, the conducting ball 516 bridges the gap between the raised portion 514 and the edge of the aperture 508, forming an electrically conducting path therebetween. Each of the plates 512*a*–512*d* is connected to a controller 518, as is the inner assembly 506. When the controller 518 detects which of the plates 512*a*–512*d* is in electrical contact with the inner assembly 506, then the orientation of the tilt switch array 500 relative to a downward direction can be obtained. For the axis set illustrated, when the ball forms a connection between the −z plate 512*c* and the inner assembly 516, the controller determines that the array's +z axis is pointing upwards. Reorientation of the tilt switch array 500 so that the conducting ball 516 bridges the gap between the assembly 506 and one of the other plates 512*a*, 512*b*, 512*d* is detected by the controller 518 when another plate 512*a*, 512*b* or 512*d* is connected to the inner assembly 506 by the conducting ball 516.

It will be appreciated that the embodiment illustrated in FIG. 5 is for illustrative purposes only and does not limit the invention. For example, the plates 512*a*–512*d* may be replaced by other components that provide contact for the ball 516, that is centrally located within the aperture 508 of the inner assembly 506. Similarly, the inner assembly 506 may simply be a number of separate conducting rings with their apertures positioned around the respective raised portions 514.

The conducting ball 516 may be formed of metal, or of a conducting rubber. The conducting ball 516 may also be a ball of mercury, particularly if the tilt switch array 500 is built sufficiently small that the surface tension of the mercury is sufficient to maintain an overall ball-like shape.

It will be appreciated that the tilt switch array 500 need not detect the orientation of two axes, but may be used simply to detect the orientation of one axis, for example, the orientation of the z-axis. This may be achieved by removing the +x and −x plates 512*a* and 512*b*, or by simply ignoring the information generated by the +x and −x plates. It will further be appreciated that the inner assembly 506 may be provided with opposing walls on all six sides, each with an aperture 508 therein. Additionally, the tilt 30 switch array 500 may be provided with three pairs of plates 512 orthogonally arranged. Such an embodiment permits the detection of which axis out of all three axes is closest to being vertical.

Figure 7B:
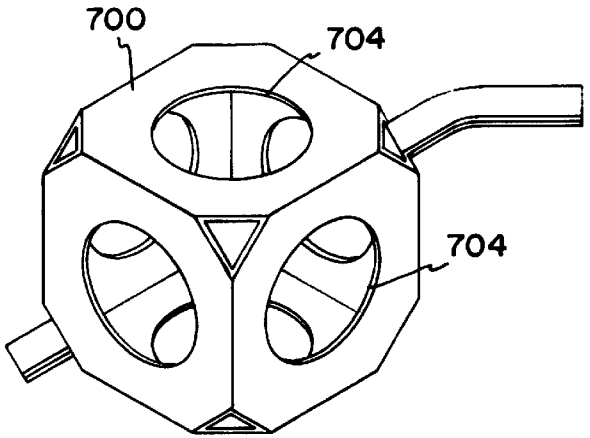
FIG. 7B illustrates the inner housing of FIG. 7B in folded form.
Figure 7A:
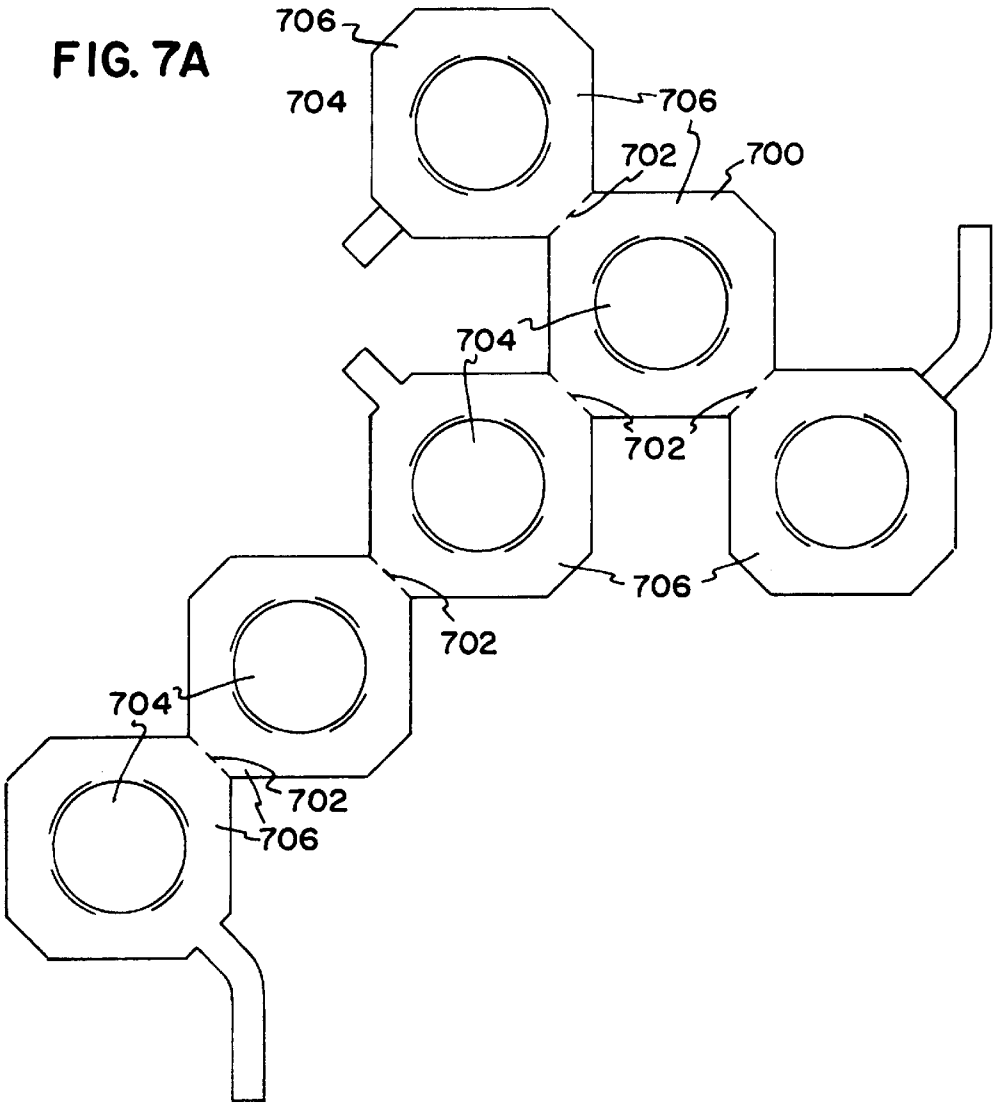
FIG. 7A illustrates an embodiment of an inner housing for a three axis tilt switch array in unfolded form.

The inner assembly may be formed from a single, stamped metal sheet which is folded into shape. For example, FIG. 7A illustrates a single stamping 700 which may be folded at joints 702 to form the inner housing 700 shown in FIG. 7B. The inner housing may be essentially cubic, as illustrated. The inner assembly 700 is illustrated having six apertures 704, one aperture 704 in each side wall, providing for a tilt switch array operational with respect to three orthogonal axes.

Figure 8:
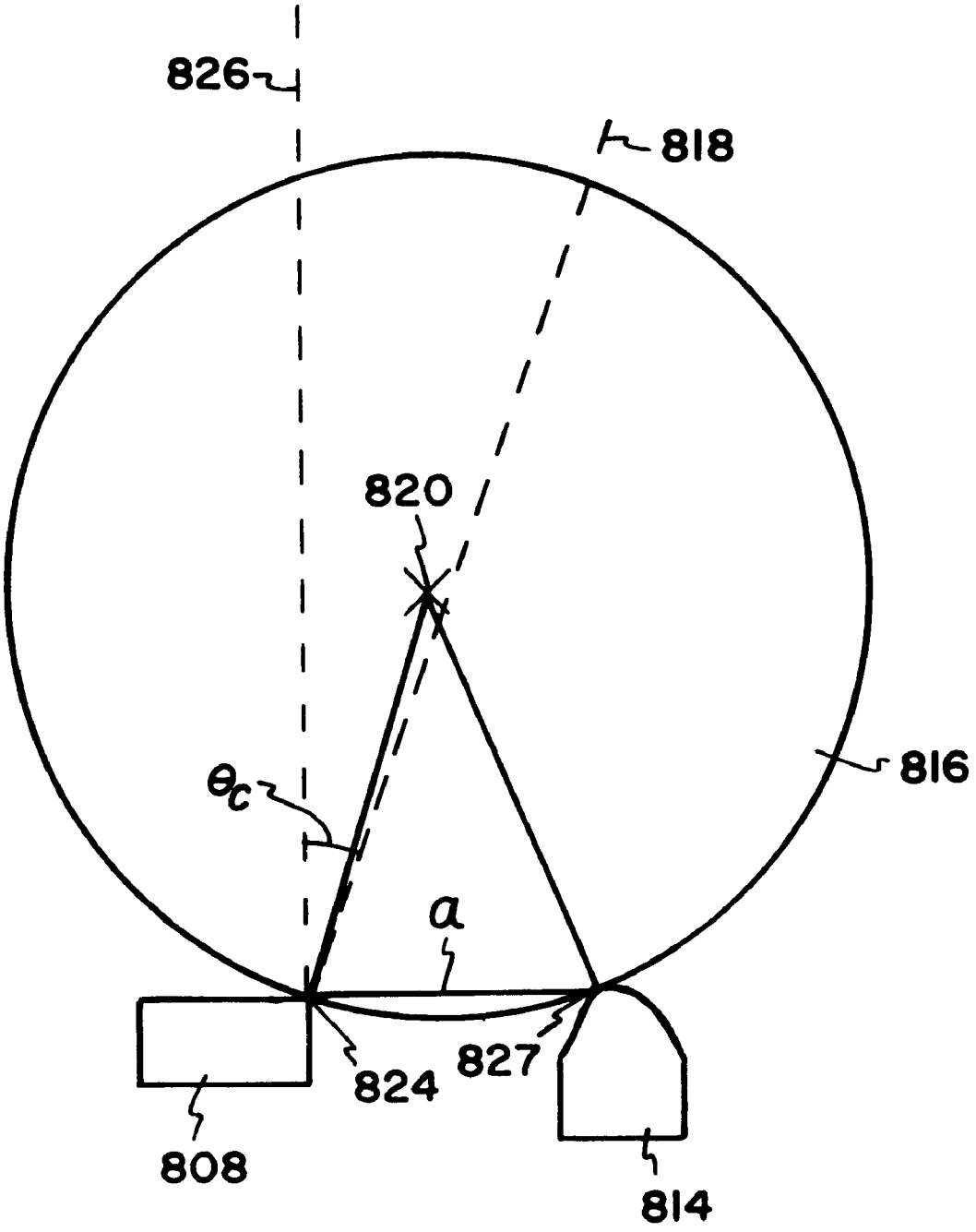
FIG. 8 illustrates the geometry of a ring and an electrode of a tilt switch gap.

Referring back to FIG. 5, an important parameter for the user of the tilt switch array 500 is the range of angle through which the tilt switch array 500 may be tilted before the ball 516 leaves the gap between the raised portion 514 and the side of the aperture 508, thus opening the circuit. This is discussed with reference to FIG. 8, which schematically illustrates a raised portion 814 and one edge of a ring, or aperture 808, with a ball 816 resting therebetween. The ball 816 is assumed to be spherical, and its center of mass at the center of the sphere. FIG. 8 illustrates a cross-section taken through the plane described by the center of the ball 816 and the point of contact 822 and 824 on the electrode 814 and the ring 808, respectively. An isosceles triangle is drawn between these three points 820, 822 and 824, with the equal sides have a length r, equal to the radius of the ball 816. The dashed lines 826 and 828 indicate different vertical axes. The first vertical axis 826 illustrates the situation where the ring 808 is horizontally placed relative the electrode 814. A vertical line from the ball's center of gravity, at X 820 intersects the line L, length a, lying between the contacting points 822 and 824. Therefore, the ball 816 sits in the gap between the electrode 814 and the ring 808. However, if the system is rotated, so that the vertical axis now lies along dashed line 828, then a vertical line drawn from the center of gravity at 820 no longer intersects the line between the two contact points 822 and 824, and the ball's position is unstable and it will fall out from the ring.

The angle, $\Theta_c$, through which the tilt switch array can be rotated before a he ball 816 falls out from the ring can be shown to be given by $$\Theta_c = \sin^{-1}\frac{a}{2r}.$$

Thus, by judicious selection of a, the separation between contact points 822 and 824 of the electrode and the ring, and r, the radius of the ball 816, the designer of the tilt switch array may select the angular tilt range over which the tilt switch array indicates that a particular axis of the tilt switch array is pointing downwards.

Figure 6:
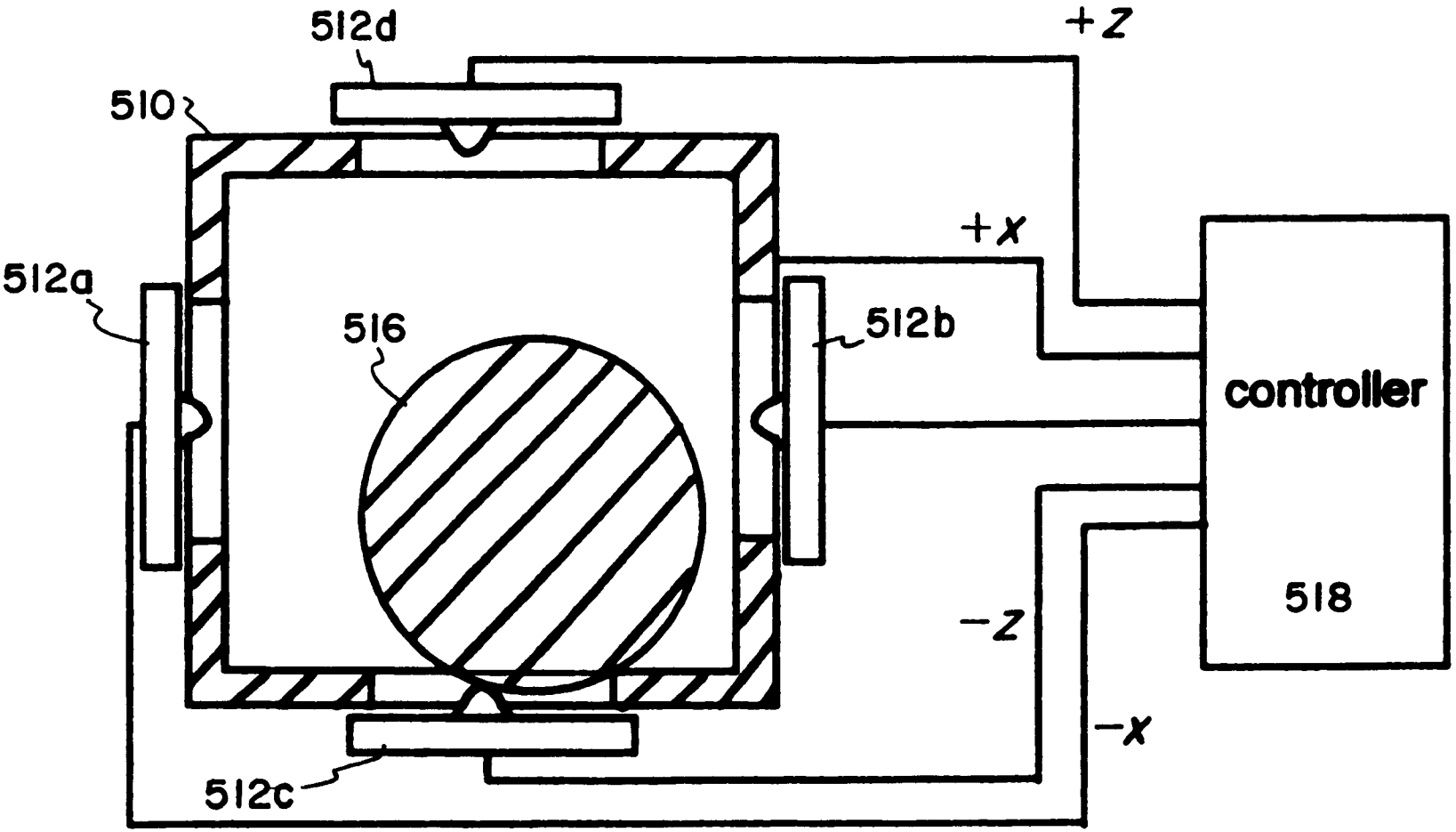
FIG. 6 illustrates a schematic cross section through the multi-axis tilt switch array of FIG. 5.

For example, in the tilt switch array illustrated in FIG. 6 detecting the relative orientation of two orthogonal axes to the downward direction, it may be desired simply to determine which axis is pointing more "upwards" than the other. In such a case, the critical angle $\theta_c$ may be set at 45°. Therefore, as the tilt switch array 600 is rotated, the ball 516 escapes from one aperture 508 and is immediately trapped by an adjacent aperture 508. Therefore, as the array 600 is rotated, there is very little "dead time" when the ball 516 is not trapped in one of the gaps of a tilt switch.

In real manufacturing situations, it may be easier to hold tolerances sufficiently tight to have a critical angle of 40° rather than 45°. Such a selection would allow increased angular coverage by the tilt switch array, and maintain minimize non-responsive angle ranges, while accepting reasonable manufacturing tolerances.

Alternatively, it may be desired to indicate which axis is pointing upwards only when that axis is within a few degrees of the vertical direction. Therefore, the critical angle may be set to be small, for example, ranging from 5° to 10°. In this case, there is a wide range of orientation angles over which none of the tilt switches in the tilt switch array are closed.

The point of the electrode that contacts the ball may not lie in the plane of the ring. It will be appreciated that, in such a case, the separation distance between the electrode and its associated ring/conducting perimeter and the diameter of the ball may be selected to provide a predetermined critical angle.

It will be appreciated that the tilt switch arrays disclosed herein may be used as jitter switches for detecting motion in addition to detecting orientation. In a jitter switch, the conducting ball makes interrupted contact with one or more of the tilt switches in the array due to its motion. For example, if the tilt switch array is used in an electronic unit that is attached to a pet animal, such as a dog, then the motion of the dog as it walks or runs may cause the conducting ball within the tilt switch array to make only intermittent contact with one or more of the tilt switches within the array. The detection of such intermittent operation may be used as an indicator that the animal is in motion.

Jitter operation of a switch may be slowed by providing a damping fluid within the tilt switch array. Viscous forces act on the conducting ball to slow the movement of the ball within the housing under small applied forces, and so the response time of the ball may be increased. Accordingly, the addition of damping fluid may increase the amount of motion required to initiate jitter-type operation.

The foregoing description of the various embodiments of the invention has been presented for the purposes of illustration and description. It is not intended to be exhaustive or to limit the invention to the precise form disclosed. For example, it is possible that pairs of electrodes may be aligned on axes where the axes are not orthogonal to each other, but simply nonparallel. Many modifications and variations are possible in light of the above teaching. It is intended that the scope of the invention be limited not by this detailed description, but rather by the claims appended hereto.

What is claimed is:

1. A tilt switch array, comprising:

an outer housing;

an inner assembly disposed within the outer housing, the inner assembly having a first pair of apertured, opposing sides;

a first plate disposed between each respective side of the first pair of opposing sides and the outer housing, each first plate having a projection thereon to form an electrode region, the first plates being electrically isolated from each other and the inner assembly, each electrode region and associated aperture perimeter in a respective opposing side forming a switch gap; and an electrically conductive element movable within the inner assembly so as to make electrical contact across one of the switch gaps by contacting one of the electrode regions and an associated aperture perimeter.

2. The tilt switch of claim 1, wherein the first pair of apertured, opposing sides define a first axis, the inner assembly includes a second pair of opposing, apertured sides defining a second axis nonparallel with respect to the first axis, and further comprising second plates disposed between apertured sides of the second pair of sides and the outer housing, each second plate having a projection thereon to form a second electrode region, the second plates being electrically isolated from each other and the inner assembly, each second electrode region and associated aperture perimeter in one of the second pair of opposing sides forming a switch gap.

3. The tilt switch array of claim 2, wherein the first and second axes are orthogonal.

4. The tilt switch array of claim 1, wherein the electrically conductive element is a metal sphere.

5. The tilt switch array of claim 1, further comprising damping fluid disposed within the housing to dampen motion of the electrically conductive element.

6. The tilt switch array of claim 1, wherein the switch gap has a length and the electrically conductive element has a diameter selected so that the tilt switch array has a critical angle less than 45°.

7. The tilt switch array of claim 1, wherein the inner assembly is formed from a single, folded sheet of metal.

8. A tilt switch array for detecting orientation, the tilt switch array comprising:

a housing having a first axis;

a first electrode pair having first and second electrodes aligned parallel to the first axis and disposed within the housing, the first and second electrodes opposing each other to form a first space therebetween, a first conducting perimeter substantially surrounding the first electrode within the housing and a second conducting perimeter substantially surrounding the second electrode within the housing, the first and second conducting perimeters each being nonparallel to the first axis;

an inner assembly, electrically isolated from the electrodes, with first and second apertures, conducting edges of first and second apertures forming the first and second conducting perimeters, respectively;

plates disposed between the inner assembly and the housing, the plates having projecting portions thereon to form the electrodes; and a conducting element movable within the first space so as to contact one of the electrodes and the conducting perimeter surrounding the one of the electrodes.

9. The tilt switch array of claim 8, further comprising electrical connectors, connected to the first and second electrodes, the connectors being connectable to an external circuit.

10. The tilt switch array of claim 8, wherein the perimeters are substantially circular.

11. The tilt switch array of claim 8, wherein the movable conducting element has a first diameter and the conducting perimeters have a second diameter, the first and second diameters being selected so that the tilt switch array has a critical angle less than approximately 45°.

12. The tilt switch array of claim 8, wherein the first and second conducting perimeters are electrically connected together.

13. The tilt switch array of claim 8, wherein the conducting element is a metal sphere.

14. The tilt switch array of claim 8, further comprising damping fluid within the housing to dampen motion of the conducting element.

15. The tilt switch array of claim 8, wherein the housing has a second axis nonparallel with respect to the first axis, and further comprising a second electrode pair having third and fourth electrodes aligned with respect to the second axis, electrically isolated from the inner assembly and disposed within the housing, the third and fourth electrodes opposing each other to form a second space therebetween, the second space intersecting the first space, a third conducting aperture edge of the inner assembly substantially surrounding the third electrode and a fourth conducting aperture edge of the inner assembly substantially surrounding the fourth electrode, the third and fourth aperture edges each being nonparallel to the second axis, the conducting element being movable within the second space.

16. The tilt switch array of claim 15, wherein the first and second axes are orthogonal.

17. The tilt switch array of claim 15, further comprising a third electrode pair having fifth and sixth electrodes aligned with respect to a third axis nonparallel to the first and second axes, electrically isolated from the inner assembly and disposed within the housing, the fifth and sixth electrodes opposing each other to form a third space therebetween, the third space intersecting the first and second spaces, a fifth conducting aperture edge of the inner assembly substantially surrounding the fifth electrode and a sixth conducting aperture edge of the inner assembly substantially surrounding the sixth electrode, and wherein the conducting element is loosely disposed within the housing so as to be free to move within the first, second and third spaces of the first, second and third axis electrode pairs.

* * * * *